US007318420B2

(12) United States Patent
Kinose

(10) Patent No.: US 7,318,420 B2
(45) Date of Patent: Jan. 15, 2008

(54) CONTROL APPARATUS FOR INTERNAL COMBUSTION ENGINE

(75) Inventor: Kenichi Kinose, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 4 days.

(21) Appl. No.: 11/366,498

(22) Filed: Mar. 3, 2006

(65) Prior Publication Data

US 2006/0207564 A1 Sep. 21, 2006

(30) Foreign Application Priority Data

Mar. 18, 2005 (JP) ..... 2005-078459

(51) Int. Cl.
*F02M 51/06* (2006.01)
*F02M 51/00* (2006.01)

(52) U.S. Cl. ..... 123/479; 361/154

(58) Field of Classification Search ..... 123/431, 123/299, 478, 479, 480, 490, 499; 73/119 A; 361/152, 154
See application file for complete search history.

(56) References Cited

U.S. PATENT DOCUMENTS 5,469,825 A 11/1995 Golab et al.
5,584,274 A * 12/1996 Fukui et al. ..... 123/406.18
6,170,462 B1 * 1/2001 Kondo ..... 123/406.18
6,173,700 B1 * 1/2001 Yamashita et al. ..... 123/490
2004/0244778 A1 12/2004 Tanaka et al.

FOREIGN PATENT DOCUMENTS

DE 100 21 086 A1 11/2001
GB 2 377 507 A 1/2003
JP A 2002-364409 12/2002
JP A 2004-137938 5/2004

* cited by examiner

*Primary Examiner*—Mahmoud Gimie
(74) *Attorney, Agent, or Firm*—Oliff & Berridge, PLC

(57) ABSTRACT

A drive control circuit supplies power to a solenoid coil in an in-cylinder injector of a cylinder in response to a fuel injection signal. A failure detection circuit to detect disconnection failure at an in-cylinder injector is arranged to be shared among cylinders whose phase of each stroke differs 360 degrees in crank angle. An engine ECU detects failure including identification of the injector with disconnection failure based on a failure detection signal from the failure detection circuit, and a crank angle detected by a crank angle sensor. The driver is notified of the failure detection result through the engine ECU.

8 Claims, 9 Drawing Sheets

FIG.4

| CRANK TURNING ANGLE | | FIRST TURN | | SECOND TURN | |
|---|---|---|---|---|---|
| | | 0 - 180 DEGREES | 180 - 360 DEGREES | 360 - 540 DEGREES | 540 - 720 DEGREES |
| CYLINDER | #1 | COMBUSTION | EXHAUST | INTAKE | COMPRESSION |
| | #2 | COMPRESSION | COMBUSTION | EXHAUST | INTAKE |
| | #3 | EXHAUST | INTAKE | COMPRESSION | COMBUSTION |
| | #4 | INTAKE | COMPRESSION | COMBUSTION | EXHAUST |

FIG.7

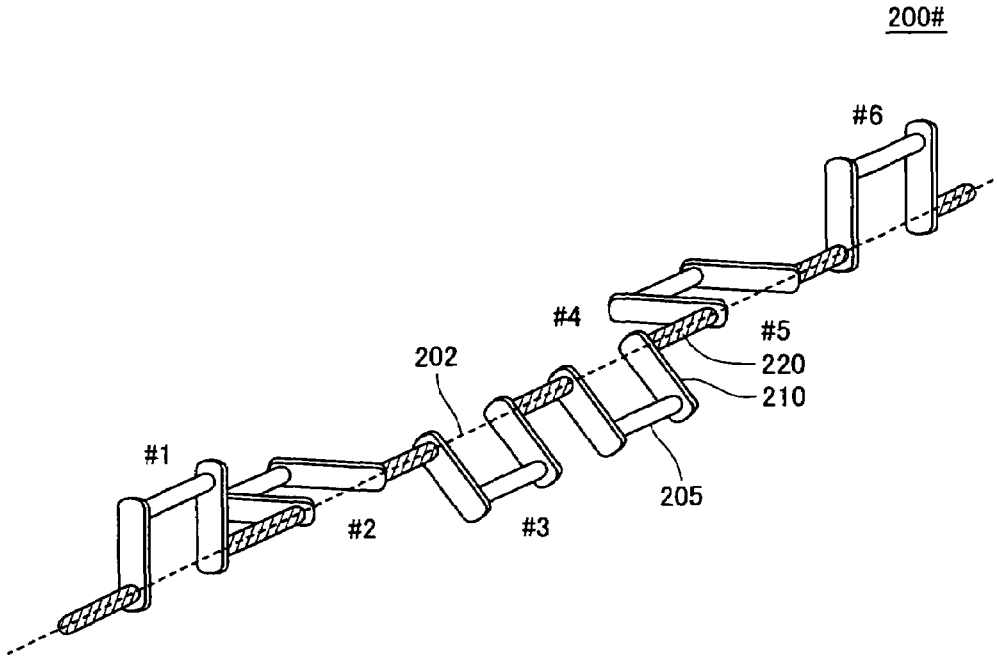

FIG.8

| CRANK TURNING ANGLE | | FIRST TURN | | SECOND TURN | |
|---|---|---|---|---|---|
| | | 0 – 180 DEGREES 60° 120° | 180 – 360 DEGREES 240° 300° | 360 – 540 DEGREES 420° 480° | 540 – 720 DEGREES 600° 660° |
| CYLINDER | No.1 | COMBUSTION | EXHAUST | INTAKE | COMPRESSION |
| | No.2 | EXHAUST | INTAKE | COMPRESSION | COMBUSTION | EXHAUST |
| | No.3 | INTAKE | COMPRESSION | COMBUSTION | EXHAUST | INTAKE |
| | No.4 | COMBUSTION | EXHAUST | INTAKE | COMPRESSION | COMBUSTION |
| | No.5 | COMPRESSION | COMBUSTION | EXHAUST | INTAKE | COMPRESSION |
| | No.6 | INTAKE | COMPRESSION | COMBUSTION | EXHAUST |

CONTROL APPARATUS FOR INTERNAL COMBUSTION ENGINE

This nonprovisional application is based on Japanese Patent Application No. 2005-078459 filed with the Japan Patent Office on Mar. 18, 2005, the entire contents of which are hereby incorporated by reference.

BACKGROUND OF THE INVENTION

1. Field of the Invention

The present invention relates to a control apparatus for an internal combustion engine, particularly a control apparatus including a disconnection failure detection function for a fuel injector.

2. Description of the Background Art

Fuel injection at an internal combustion engine is generally executed by an injector (fuel injection valve) provided at each cylinder. An injector is formed including a solenoid coil acting as an electromagnet when current is applied in response to a fuel injection signal. The period of fuel injection from the injector must be set precisely in order to achieve an appropriate fuel injection timing and fuel injecting quantity corresponding to the operating state of the internal combustion engine.

An injector of a general configuration has the fuel injection period controlled by regulating the current applied to the solenoid coil that functions as an electromagnet when current is applied. Specifically, when current is not applied to the solenoid coil, the injection hole of the injector is blocked by a needle that is pushed from behind in response to the force of the spring arranged at the rear side of the plunger core. When current is applied the solenoid coil, the plunger core is attracted by the generated magnetic force. This movement of the plunger core causes the needle to be removed from the injection hole, whereby fuel is injected at a predetermined pressure from the injection hole.

In the case where current is not applied to the solenoid coil when a fuel injection signal is generated due to occurrence of disconnection failure at the injector, fuel injection cannot be conducted in a desirable manner. This may cause engine output degradation, leading to the possibility of adversely affecting the operation status of the vehicle. Therefore, disconnection failure at an injector must be promptly identified, including which injector has failed, and inform the driver of the failure.

In view of the foregoing, there is proposed a system of detecting and identifying disconnection at each signal line through which a fuel injection signal is transmitted for each cylinder in an internal combustion engine with a plurality of cylinders (for example, Japanese Patent Laying-Open No. 2004-137938; hereinafter referred to as Patent Document 1). The disconnection detection apparatus for an internal combustion engine disclosed in Patent Document 1 has a history flag generated, representing whether each of fuel injection signals received in parallel for each cylinder from the main control circuit had been received or not. By monitoring the status of the history flag stored in a memory, the cylinder with disconnection at the signal line can be identified.

As one type of engine, there is known an internal combustion engine that includes an in-cylinder injector directly injecting fuel into the combustion engine and an intake manifold injector injecting fuel into an intake port (intake manifold) for each cylinder. For such an internal combustion engine, there is proposed a configuration in which the in-cylinder injector and intake manifold injector are used appropriately so as to partake in fuel injection in an even combustion operation mode of (for example, Japanese Patent Laying-Open No. 2002-364409; hereinafter referred to as Patent Document 2).

In an internal combustion engine of a configuration that includes both an in-cylinder injector and an intake manifold injector, as disclosed in Patent Document 2, there will be an appreciable number of injectors arranged for the entire internal combustion engine. In the case where the internal combustion engine takes a configuration in which a mechanism is provided corresponding to each injector, the number of failure detection mechanisms that has to be arranged will also be appreciable. It is therefore necessary to arrange efficiently a failure detection configuration that allows identification of the injector where disconnection failure has occurred.

SUMMARY OF THE INVENTION

In view of the foregoing, an object of the present invention is to provide a control apparatus that can efficiently detect injector disconnection failure, including identification of the injector with disconnection failure, in an internal combustion engine including a plurality of injectors, particularly an internal combustion engine of a configuration including both an in-cylinder injector and an intake manifold injector for each cylinder.

A control apparatus according to an aspect of the present invention is directed to an internal combustion engine that includes a plurality of cylinders coupled to a common crankshaft, and that has a fuel injection mechanism for injecting fuel when current is applied, arranged at each cylinder. The control apparatus includes a control circuit, a drive control circuit, a failure detection circuit, and a crank angle detector. The control circuit is configured to generate a control signal indicating the fuel injection period from the fuel injection mechanism. The drive control circuit is configured to supply power to the fuel injection mechanism in response to a control signal from the control circuit. The failure detection circuit is electrically connected to at least one fuel injection mechanism, and is configured to detect disconnection failure of the fuel injection mechanism during power supply by the drive control circuit corresponding to the connected fuel injection mechanism. The crank angle detector detects the turning angle of the crankshaft. The failure detection circuit is arranged to be electrically connected common to a plurality of fuel injection mechanisms whose fuel injection period does not overlap in time. The control circuit identifies the fuel injection mechanism with disconnection failure based on the detected result by the failure detection circuit and the turning angle detected by the crank angle detector.

The control apparatus for an internal combustion engine set forth above is configured such that the failure detection circuit is shared by a plurality of fuel injection mechanisms whose fuel injection period does not overlap in time, among the fuel injection mechanisms of the plurality of cylinders, and the fuel injection mechanism (injector) with disconnection failure can be identified based on the disconnection failure detection by the shared failure detection circuit and the crank angle of the internal combustion engine. As a result, the fabrication cost of the internal combustion engine can be reduced by virtue of the efficient arrangement of suppressing the number of failure detection circuits arranged with respect to the number of fuel injection mechanisms (injectors).

A control apparatus according to another aspect of the present invention is directed to an internal combustion engine that includes a plurality of cylinders coupled to a common crankshaft, and that has a first fuel injection mechanism to inject fuel into a cylinder and a second fuel injection mechanism to inject fuel into an intake manifold when current is applied, arranged at each cylinder. The control apparatus includes a control circuit, a drive control circuit, a first failure detection circuit, a second failure detection circuit, and a crank angle detector. The control circuit is configured to control the injection ratio of the fuel injection quantity between the first fuel injection mechanism and the second fuel injection mechanism to the entire fuel injection quantity according to the operating state, and generate a plurality of control signals indicating the fuel injection period of the first and second fuel injection mechanisms at each cylinder according to the entire fuel injection quantity and fuel injection ratio. The drive control circuit is configured to supply power to each of the first and second fuel injection mechanisms at each cylinder in response to the plurality of control signals from the control circuit. The first failure detection circuit is electrically connected to at least one first fuel injection mechanism, and is configured to detect disconnection failure of the connected first fuel injection mechanism when power is supplied by the drive control circuit corresponding to the connected first fuel injection mechanism. The second failure detection circuit is electrically connected to at least one second fuel injection mechanism, and is configured to detect disconnection failure of the connected second fuel injection mechanism when power is supplied by the drive control circuit corresponding to the connected second fuel injection mechanism. The crank angle detector detects the turning angle of the crankshaft. At least one of the first and second failure detection circuits is arranged to be electrically connected common to a plurality of corresponding fuel injection mechanisms whose fuel injection period does not overlap in time. The control circuit identifies the first and second fuel injection mechanisms with disconnection failure based on the detected result by the failure detection circuit and the turning angle detected by the crank angle detector.

In the control apparatus for an internal combustion engine set forth above, a first failure detection circuit detecting disconnection failure at the first fuel injection mechanism and a second failure detection circuit detecting disconnection failure at the second fuel injection mechanisms are both provided for the internal combustion engine that has a first fuel injection mechanism (injector) for in-cylinder injection and a second fuel injection mechanism (injector) for intake manifold injection arranged at each cylinder. Accordingly, disconnection failure at a fuel injection mechanism can be detected reliably even under an operation status in which disconnection failure of just one of the fuel injection mechanisms (injector) will not lead to engine speed variation by the operation of the first and second fuel injection mechanisms partaking in fuel injection.

By virtue of sharing the failure detection circuit among a plurality of fuel injection mechanisms (injector) whose fuel injection period does not overlap, the number of first and second failure detection circuits arranged can be reduced as compared to the number of first and second fuel injection mechanisms arranged. As a result, the fuel injection mechanism with disconnection failure can be identified without significant increase in the number of failure detection circuits arranged in an internal combustion engine of a configuration that includes a plurality of fuel injection mechanisms at each cylinder.

Preferably in the control apparatus for an internal combustion engine of the present invention, the first failure detection circuit is arranged for every two cylinders whose phase difference across the same stroke is 360 degrees in crank turning angle, and is electrically connected common to the first fuel injection mechanisms arranged at each of the two cylinders.

According to the control apparatus for an internal combustion engine set forth above, by arranging the failure detection circuit for every two cylinders whose phase difference across the same stroke is 360 degrees in crank turning angle with respect to the first fuel injection mechanisms (in-cylinder injector), a configuration in which the failure detection circuit can be shared among first fuel injection mechanisms whose fuel injection period does not overlap in time can be realized. Thus, disconnection failure at a first fuel injection mechanism can be detected and the cylinder with the disconnection failure can be identified by fewer failure detection circuits, i.e. half the number of the cylinders.

Further preferably in the control apparatus for an internal combustion engine of the present invention, the second failure detection circuit is arranged electrically connected common to the second fuel injection mechanisms arranged at each cylinder.

According to the control apparatus for an internal combustion engine set forth above, the failure detection circuit is shared by all the cylinders with respect to the second fuel injection mechanisms (intake manifold injector). In the operation region where degradation in engine output due to disconnection failure becomes a problem, a configuration can be realized in which the failure detection circuit is shared by a plurality of second fuel injection mechanisms whose fuel injection period do not overlap in time since fuel injection is conducted mainly by the first fuel injection mechanism (in-cylinder injector) and the fuel injection quantity from the second fuel injection mechanism (intake manifold injector) is reduced (that is, the fuel injection period becomes shorter). Thus, disconnection failure at a second fuel injection mechanism in all cylinders can be detected, and the cylinder with disconnection failure can be identified by a unitary failure detection circuit.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4 is a diagram to describe the engine cycle with respect to each cylinder.

FIG. 7 is a schematic diagram to describe a configuration of the crankshaft to which each cylinder is coupled in a 6-cylinder engine.

FIG. 8 is a diagram to describe the engine cycle with respect to each cylinder in a 6-cylinder engine.

DESCRIPTION OF THE PREFERRED EMBODIMENTS

Figure 1:
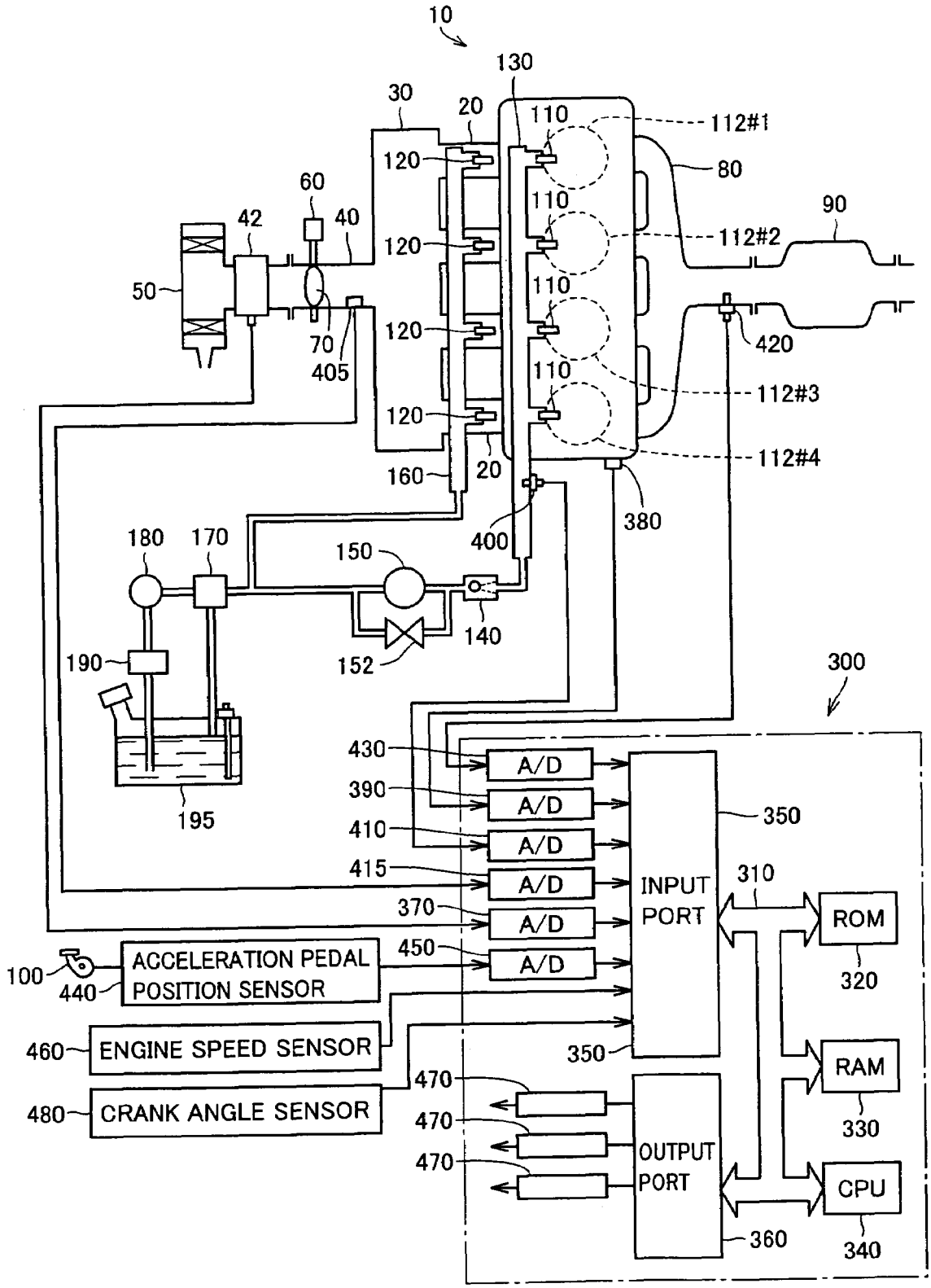
FIG. 1 is a schematic diagram of an engine system under control of an engine ECU (Electronic Control Unit) qualified as a control apparatus for an internal combustion engine according to an embodiment of the present invention.

Embodiments of the present invention will be described in detail hereinafter with reference to the drawings. The same or corresponding elements in the drawings have the same reference characters allotted, and details of the description will not be repeated.

FIG. 1 is a schematic view of a configuration of an engine system under control of an engine ECU qualified as a control apparatus for an internal combustion engine according to an embodiment of the present invention. Although a straight-4 gasoline engine is shown in FIG. 1, application of the present invention is not limited to such an engine.

Referring to FIG. 1, an engine (internal combustion engine) 10 includes four cylinders 112#1-112#4. In the following, cylinders 112#1-112#4 will be simply designated "cylinder 112" or "each cylinder 112" when they are to be represented generically without discrimination therebetween.

A common surge tank 30 is connected to each cylinder 112 via a corresponding intake manifold 20. Surge tank 30 is connected to an air cleaner 50 via an intake duct 40. In intake duct 40 are disposed an air flow meter 42 and a throttle valve 70 driven by an electric motor 60. Throttle valve 70 has its opening controlled based on an output signal from engine ECU 300, independent of an accelerator pedal 100. A common exhaust manifold 80 is coupled to each cylinder 112. Exhaust manifold 80 is coupled to a 3-way catalytic converter 90.

Each cylinder 112 is provided with an in-cylinder injector 110 to inject fuel into the cylinder, and an intake manifold injector120 to inject fuel towards an intake port and/or intake manifold. Injectors 110 and 120 are under control of an output signal from engine ECU 300.

As shown in FIG. 1, each in-cylinder injector 110 is connected to a common fuel delivery pipe 130. This fuel delivery pipe 130 is connected to an engine-driven type high pressure fuel pump 150 via a check valve 140 that can communicate with fuel delivery pipe 130. The output side of high pressure fuel pump 150 is coupled to the intake side of high pressure fuel pump 150 via an electromagnetic spill valve 152. The amount of fuel supplied from high pressure fuel pump 150 into fuel delivery pipe 130 increases as the opening of electromagnetic spill valve 152 becomes smaller. When electromagnetic spill valve 152 is fully open, fuel supply from high pressure fuel pump 150 to fuel delivery pipe 130 is suppressed. Electromagnetic spill valve 152 is controlled by an output signal from engine ECU 300.

Each intake manifold injector 120 is connected to a common fuel delivery pipe 160 of the low pressure side. Fuel delivery pipe 160 and high pressure fuel pump 150 are connected to a low pressure fuel pump 180 of an electric motor driven type via a common fuel pressure regulator 170. Low pressure fuel pump 180 is connected to a fuel tank 195 with a fuel filter 190 therebetween. Fuel pressure regulator 170 is configured to return a portion of the fuel output from low pressure fuel pump 180 to fuel tank 195 when the pressure of the fuel output from low pressure fuel pump 180 becomes higher than a predetermined set pressure. Accordingly, the pressure of the fuel supplied to intake manifold injector 120 and the pressure of the fuel supplied to high pressure fuel pump 150 are prevented from becoming higher than the set fuel pressure.

Engine ECU 300 is formed of a digital computer, including a ROM (Read Only Memory) 320, a RAM (Random Access Memory) 330, a CPU (Central Processing Unit) 340, an input port 350, and an output port 360, connected to each other via a bidirectional bus 310.

Air flow meter 42 generates an output voltage in proportion to the intake air. The output voltage from air flow meter 42 is applied to an input port 350 via an A/D converter 370. A coolant temperature sensor 380 producing an output voltage in proportion to the engine coolant temperature is attached to engine 10. The output voltage from coolant temperature sensor 380 is applied to input port 350 via an A/D converter 390.

A fuel pressure sensor 400 producing an output voltage in proportion to the fuel pressure in fuel delivery pipe 130 is attached to fuel delivery pipe 130. The output voltage from fuel pressure sensor 400 is applied to input port 350 via an A/D converter 410. An air-fuel ratio sensor 420 producing an output voltage in proportion to the oxygen concentration in the exhaust gas is attached to exhaust manifold 80 upstream of 3-way catalytic converter 90. The output voltage from air-fuel ratio sensor 420 is applied to input port 350 via an A/D converter 430.

Air-fuel ratio sensor 420 in the engine system of the present embodiment is a full-range air-fuel ratio sensor (linear air-fuel ratio sensor) producing an output voltage in proportion to the air-fuel ratio of the mixture burned at engine 10. Air-fuel ratio sensor 420 may be an $O_2$ sensor that detects whether the air-fuel ratio of air-fuel mixture burned at engine 10 is rich or lean with respect to the stoichiometric ratio in an ON/OFF manner.

An accelerator pedal position sensor 440 producing an output voltage in proportion to the pedal position of accelerator pedal 100 is attached to accelerator pedal 100. The output voltage from accelerator pedal position sensor 440 is applied to input port 350 via an A/D converter 450. An engine speed sensor 460 generating an output pulse representing the engine speed is connected to input port 350. ROM 320 of engine 300 stores the value of the fuel injection quantity set corresponding to the operating state, a correction value according to the engine coolant temperature and the like that are mapped in advance, based on the engine load factor and engine speed obtained through accelerator pedal position sensor 440 and engine speed sensor 460 set forth above.

An air temperature sensor 405 is provided at any of the channels to intake manifold 20, surge tank 30, and intake duct 40. Air temperature sensor 405 produces an output voltage corresponding to the temperature of the intake air. The output voltage from air temperature sensor 405 is applied to intake port 350 via an A/D converter 415.

A crank angle sensor 480 is formed including a rotor attached to the crankshaft of engine 10, and an electromagnetic pickup arranged in the proximity of the rotor to detect passage of a projection provided at the outer circumference of the rotor. Crank angle sensor 480 functions to detect the rotation phase of the crankshaft. The output from crank angle sensor 480 is applied to input port 350 as a pulse signal generated at every passage of the projection.

Engine ECU 300 generates various control signals to control the entire operation of the engine system based on signals from respective sensors by execution of a predetermined program. The control signals are transmitted via output port 360 and drive circuit 470 to the group of devices and circuits constituting the engine system.

In engine 10 of an embodiment of the present invention, both an in-cylinder injector 110 and an intake manifold injector 120 are provided at each cylinder 112. Therefore, fuel injection partaking control between in-cylinder injector 110 and intake manifold injector 120 must be conducted with respect to the entire required fuel injection quantity calculated as set forth above.

In the following, the fuel injection ratio between the two injectors is represented as "DI ratio r", that is the ratio of the fuel injection quantity from in-cylinder injector 110 to the entire fuel injection quantity. "DI RATIO r=100%" implies that fuel injection is carried out using only in-cylinder injector 110, and "DI RATIO r=0%" implies that fuel injection is carried out using only intake manifold injector 120. "DI RATIO r≠0%", "DI RATIO r≠100%" and "0%<DI RATIO r<100%" each implies that fuel injection is carried out using both in-cylinder injector 110 and intake manifold injector 120. It is to be noted that in-cylinder injector 110 contributes to increase in the output performance by improvement of the anti-knocking performance by latent heat of vaporization, whereas intake manifold injector 120 contributes to increase in the output performance by suppressing rotation (torque) variation by the homogenous improvement effect of air-fuel mixture.

The structure of the engine will be further described with reference to FIG. 2.

Figure 2:
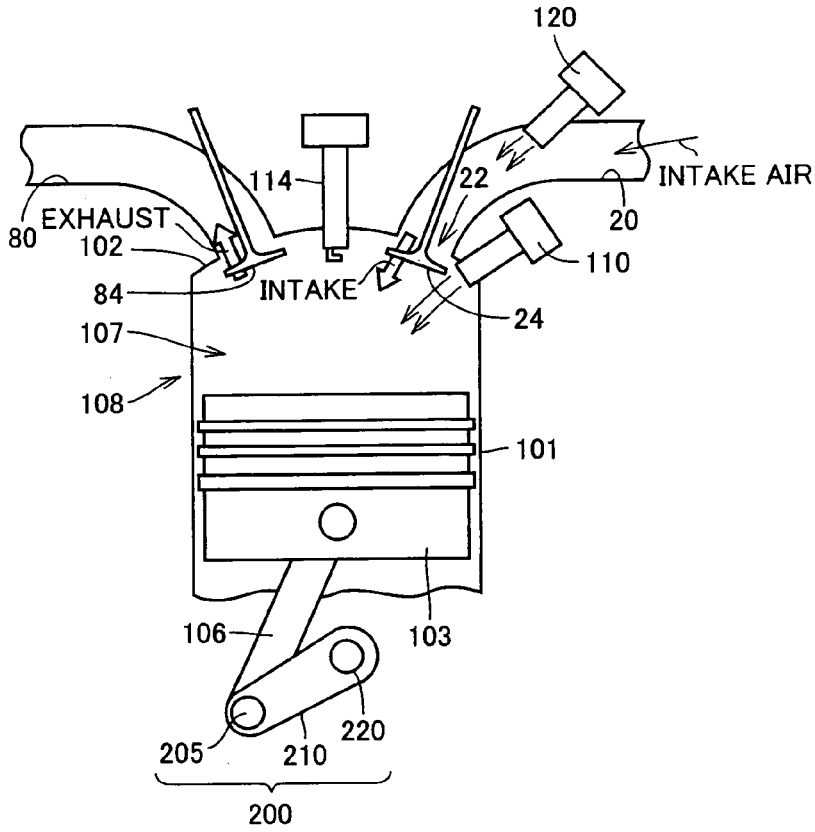
FIG. 2 is a diagram to describe a configuration of the engine of FIG. 1.

Referring to FIG. 2, each cylinder includes a cylinder block 101, a cylinder 108 with a cylinder head 102 coupled to the upper portion of cylinder block 101, and a piston 103 that reciprocates in cylinder 108.

In cylinder 108 is formed a combustion chamber 107 for combustion of air-fuel mixture, partitioned by the inner walls of cylinder block 101 and cylinder head 102 and the top of the piston. Cylinder head 102 is provided with a spark plug 114 protruding into combustion chamber 107 to ignite the air-fuel mixture, and an in-cylinder injector 110 injecting fuel into combustion chamber 107. Intake manifold injector 120 is arranged to inject fuel towards intake port 22 that is the communicating portion between intake manifold 20 and combustion chamber 107, and/or towards intake manifold 20.

The air-fuel mixture including the fuel injected to intake manifold 20 and/or intake port 22 is guided into combustion chamber 107 during the opening period of intake valve 24. The exhaust subsequent to the burning of fuel by the ignition of spark plug 114 is delivered to 3-way catalytic converter 90 via exhaust channel 80 during the opening period of an exhaust valve 84.

By the fuel combustion at combustion chamber 107, piston 103 reciprocates in cylinder 108. Piston 103 is connected to a crankshaft 200 that is the output shaft of engine 10 via a connecting rod 106. Crankshaft 200 includes a crankpin 205, a crankarm 210, and a crank journal 220.

Figure 3:
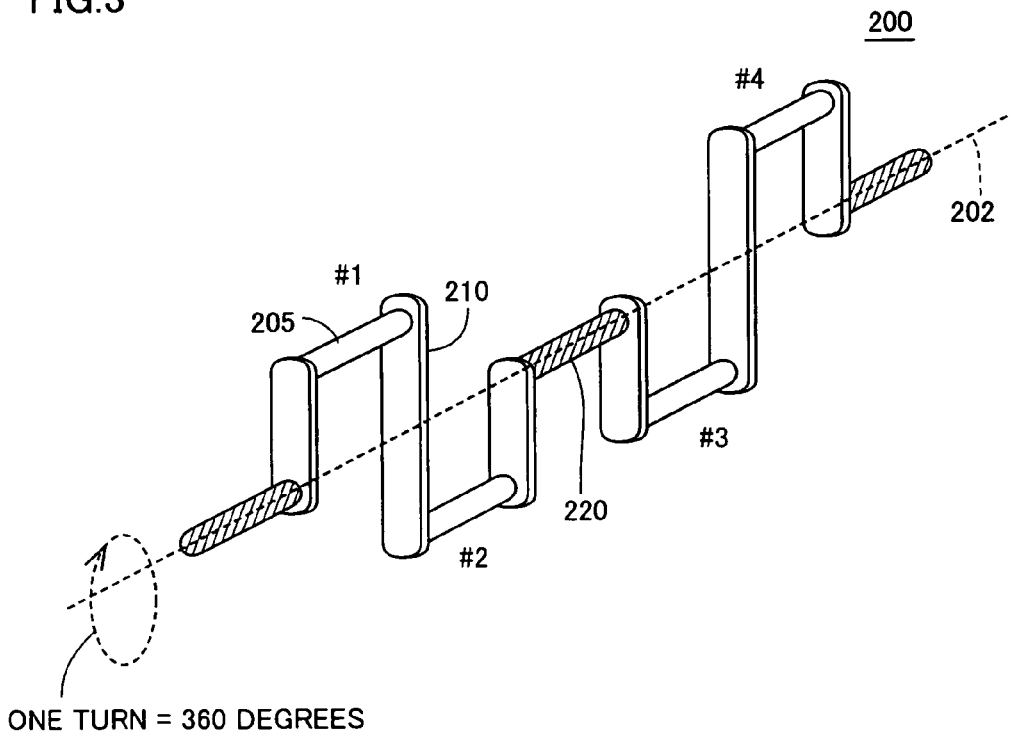
FIG. 3 is a schematic diagram to describe a configuration of the crankshaft to which each cylinder is coupled.

Referring to FIG. 3, crankshaft 200 is provided common to each cylinder 112 of engine 10. Each of cylinders 112#1-#112#4 is connected to crankshaft 200 by means of one end of connecting rod 106 coupled with crankpin 205. Crank journal 220 is equivalent to the principle axis of crankshaft 200. Crankarm 210 couples crankpin 205 and crank journal 220.

The reciprocating motion of piston 103 in sequentially-ignited cylinders 112#1-112#4 is converted into a rotary motion of crankshaft 200 with a crank rotation axis 202 as the center axis.

As shown in FIG. 4, one engine cycle of each cylinder 112 is composed of an intake stroke, a compression stroke, a combustion stroke, and an exhaust stroke. Each stroke corresponds to 180 degrees of the crank turning angle. Cylinders 112#1-112#4 are sequentially ignited in the order of 1→# 2→#4→#3, and respective strokes are sequentially executed in each cylinder. Two turns (720 degrees) of crankshaft 200 corresponds to one engine cycle. By attaching crank angle sensor 480 shown in FIG. 1 to crankshaft 200, the phase of crankshaft 200, i.e. degree of rotation (hereinafter, referred to as "crank turning angle (0-720 degrees)" can be detected at the step of a predetermined angle corresponding to the arranged pitch of the projection within the range of 0-720 degrees.

The fuel injection period of intake manifold injector 120 is set at the exhaust stroke (when intake valve 24 is closed) or intake stroke of each cylinder 112, whereas the fuel injection period of in-cylinder injector 110 is set at at least one of the intake stroke and compression stroke according to the operating status. At which stroke the fuel injection period is to be set corresponding to a point in time is determined common to each cylinder 112 by engine ECU 300.

Figure 5:
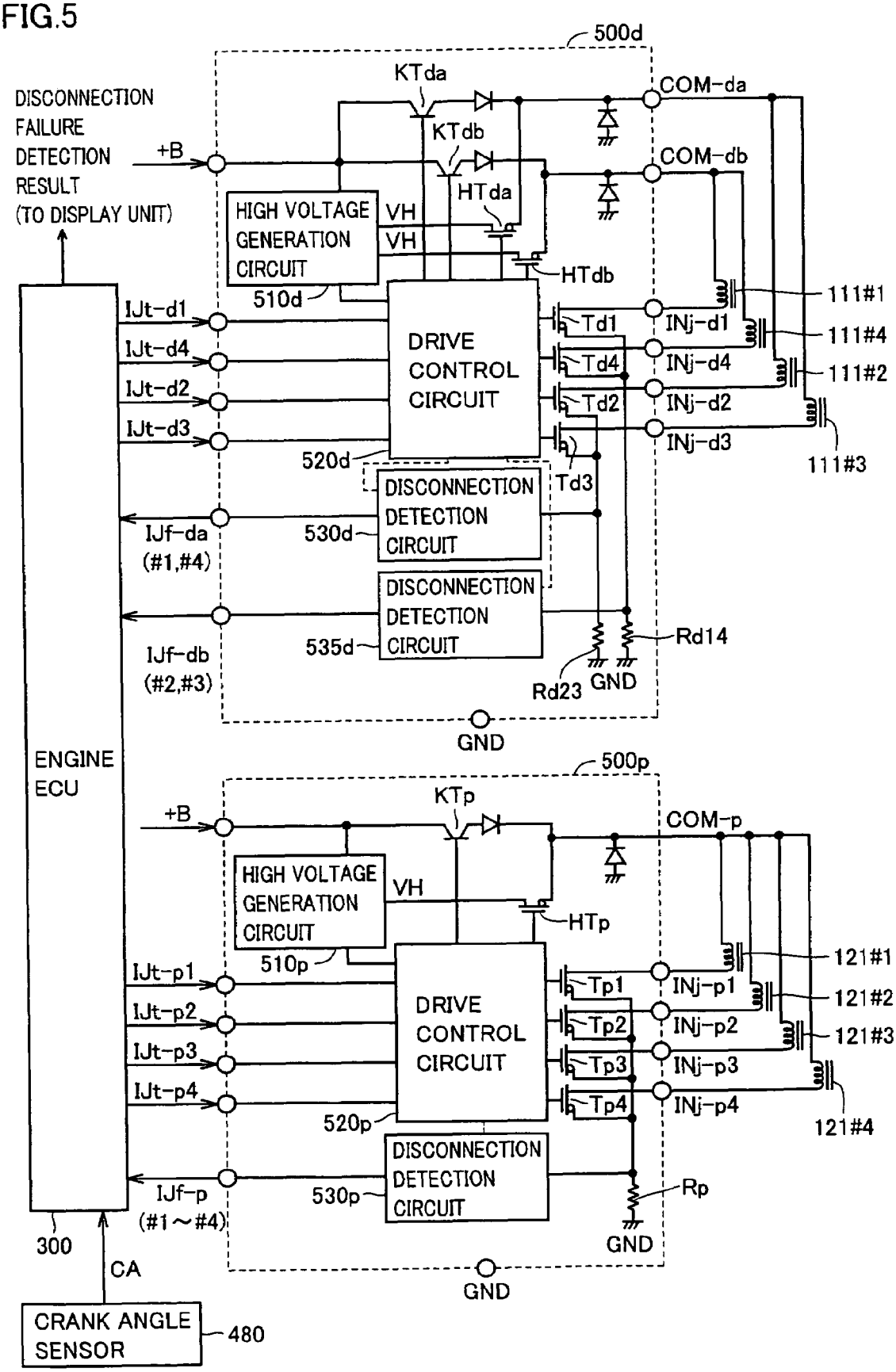
FIG. 5 is a block diagram to describe a configuration of a drive circuit for each injector of the engine system according to an embodiment of the present invention.

FIG. 5 is a block diagram to describe a configuration of the drive circuit of each cylinder in the engine system according to an embodiment of the present invention.

Referring to FIG. 5, an injector driving unit **500*d* and an injector driving unit 500*p* are provided corresponding to in-cylinder injector 110 and intake manifold injector 120**, respectively.

Injector driving unit **500*d* controls power supply to solenoid coils 111#1-111#4 in response to fuel injection signals IJt-d1-IJt-d4 from engine ECU 300. Solenoid coils 111#1-111#4 are incorporated in each in-cylinder injector 110 of cylinders 112#1-112#4**, respectively.

Solenoid coil 111#1 is connected between a node COM-db and a node INj-d1. Solenoid coil 111#2 is connected between a node COM-da and a node INj-d2. Solenoid coil 111#3 is connected between a node COM-da and a node INj-d3. Solenoid coil 111#4 is connected between a node COM-db and a node INj-d4. A corresponding in-cylinder injector 110 injects fuel towards the combustion chamber when current is applied to each of solenoid coils 111#1-111#4.

In a similar manner, injector driving unit **500*p* controls power supply to solenoid coils 121#1-121#4 in response to fuel injection signals IJt-p1-IJt-p4 from engine ECU 300. Solenoid coils 121#1-121#4 are incorporated in each intake manifold injector 120 of cylinders 112#1-112#4**, respectively.

Solenoid coils 121#1-121#4 are connected between nodes COM-p and nodes INj-p1-INj-p4, respectively. A corresponding intake manifold injector 120 injects fuel towards the intake manifold and/or intake port when current is applied to each of solenoid coils 121#1-121#4.

Fuel injection signals IJt-d1-IJt-d4 correspond to each in-cylinder injector 110 of cylinders 112#1-112#4, respectively. The fuel injection signal is set at a logical high level (hereinafter, designated as H level) during the fuel injection period of a corresponding in-cylinder injector 110, and set at a logical low level (hereinafter, designated as L level) when not in a fuel injection period. In a similar manner, fuel injection signals IJt-p1-IJt-p4 correspond to each intake manifold injector 120 of cylinders 112#1-112#4, respectively. The fuel injection signal is set at an H level when in the fuel injection period and set an L level when not in the fuel injection period for a corresponding intake manifold injector 120.

The configuration of power supply control to the injector by injector driving units 500*d* and 500*p* will be described hereinafter.

Injector driving unit 500*d* includes a high voltage generation circuit 510*d*, a drive control circuit 520*d*, high voltage supply transistors HTda, HTdb, supply control transistors Td1-Td4, and voltage supply transistors KTda and KTdb.

High voltage generation circuit 510*d* receives a power supply voltage +B to generate a high voltage VH. High voltage supply transistors HTda and HTdb are arranged to supply high voltage VH to nodes COM-da and COM-db during conduction. Voltage supply transistors KTda and KTdb are arranged to supply power supply voltage +B to nodes COM-da and COM-db during conduction. Supply control transistors Td1-Td4 are connected between nodes INj-d1-INj-d4 and ground voltage GND via a resistor element Rd14 or Rd23. High voltage supply transistors HTda, HTdb, voltage supply transistors KTda, KTdb, and supply control transistors Td1-Td4 are rendered conductive (ON) and non-conductive (OFF) by drive control circuit 520*d*.

Injector driving unit 500*p* includes a high voltage generation circuit 510*p*, a drive control circuit 520*p*, a high voltage supply transistor HTp, supply control transistors Tp1-Tp4, and a voltage supply transistor KTp.

High voltage generation circuit 510*p* receives power supply voltage +B to generate high voltage VH. High voltage supply transistor HTp is arranged to supply high voltage VH to node COM-p during conduction. Voltage supply transistor KTp is arranged to supply power supply voltage +B to node COM-p during conduction. Supply control transistors Tp1-Tp4 are connected between nodes INj-p1-INj-p4 and ground voltage GND via a resistor element Rd. High voltage supply transistor HTp, voltage supply transistor KTp, and supply control transistors Tp1-Tp4 are rendered conductive (ON) and non-conductive (OFF) by drive control circuit 520*p*.

The power supply operation to an injector by injector driving units 500*d* and 500*p* will be described based on supplying power to solenoid coil 111#1 in response to fuel injection signal IJt-d1 by injector driving unit 500*d*, as a representative example thereof.

When fuel injection signal IJt-d1 rises to an H level from an L level, drive control circuit 520 renders high voltage supply transistor HTdb and supply control transistor Td1 conductive. Accordingly, node COM-db is connected to high voltage VH, and node INj-d1 is connected to ground voltage GND. As a result, the drive of solenoid coil 111#1 by high voltage VH initiates current supply to solenoid coil 111#1, whereby fuel injection from a corresponding in-cylinder injector 110 starts.

Following initiation of current supply, drive control circuit 520*d* renders voltage supply transistor KTdb conductive, instead of high voltage supply transistor HTdb. The conduction of supply control transistor Td1 is maintained. Thus, supply of current to solenoid coil 111#1 is maintained such that fuel injection from corresponding in-cylinder injector 110 is continued.

When fuel injection signal IJt-d1 falls to an L level from an H level to end the fuel injection period, drive control circuit 520*d* renders non-conductive each of high voltage supply transistor HTdb, voltage supply transistor KTdb, and supply control transistor Td1. Thus, current supply to solenoid coil 111#1 ends, and fuel injection from corresponding in-cylinder injector 110 is ceased.

The supply power operation to other solenoid coils 111#2-111#4 and 121#1-121#4 is executed in a manner similar to that of solenoid coil 111#1 set forth above. By the supply power operation to solenoid coils 111#1-111#4 and 121#1-121#4 by drive control circuits 520*d* and 520*p*, the fuel injection period of each in-cylinder injector 110 and each intake manifold injector 120 is set.

Detection of "disconnection failure" corresponding to a state in which the corresponding solenoid coil is not energized properly in response to a fuel injection signal such that fuel injection from the cylinder is not effected in the fuel injection period will be described hereinafter.

Injector driving unit 500*d* includes a disconnection detection circuit 530*d* provided common to cylinders 112#2 and 112#3, and a disconnection detection circuit 535*d* provided common to cylinders 112#1 and 112#4.

Since the fuel injection period of in-cylinder injector 110 is set at at least one of the intake stroke and compression stroke of each cylinder 112, the provision of a disconnection detection circuit for every two cylinders whose phase difference across the same stroke is 360 degrees in crank turning angle allows the disconnection detection circuit to be shared between in-cylinder injectors 110 whose fuel injection period does not overlap in time.

Disconnection detection circuit 530*d* is connected to solenoid coils 111#2 and 111#3 via supply control transistors Td2 and Td3, respectively. Specifically, disconnection detection circuit 530*d* is electrically connected common to solenoid coils 111#2 and 111#3. Disconnection detection circuit 535*d* is connected to solenoid coils 111#1 and 111#4 via supply control transistors Td1 and Td4, respectively. In other words, disconnection detection circuit 535*d* is electrically connected common to solenoid coils 111#1 and 111#4.

Each of solenoid coils 111#1-111#4 is connected to a corresponding disconnection detection circuit 530*d* or 535*d* by a corresponding one of supply control transistors Td1-Td4 rendered conductive during a supply power operation by drive control circuit 520*d*. Accordingly, each of disconnection detection circuits 530*d* and 535*d* can monitor the electrical output (for example, occurrence of counter electromotive force) during the supply power operation mode to each solenoid coil by virtue of electrical connection with the solenoid coil that is the subject of supplying power by drive control circuit 520.

Disconnection detection circuit 530*d* monitors whether counter electromotive force that should be generated during a proper energization state of a connected solenoid coil 111#2 or 111#3 at each H level period of fuel injection signals IJt-d2 and IJt-d3 has been generated or not, and sets failure detection signal IJf-da at an H level when a counter electromotive force is not properly detected. In a similar manner, disconnection detection circuit 535*d* monitors whether counter electromotive force that should be generated during a proper energization state of connected solenoid coils 111#1 or 111#4 at each H level period of fuel injection signals IJt-d1 and IJt-d4 has been generated or not, and sets failure detection signal IJf-db at an H level when a counter electromotive force is not properly detected.

When failure is not detected including the case where counter electromotive force is properly detected, failure detection signals IJf-da and IJf-db are set at an L level. Failure detection signals IJf-da and IJf-db are transmitted to engine ECU 300 from disconnection detection circuits 530*d* and 535*d*.

Therefore, when disconnection failure occurs at an in-cylinder injector in cylinder 112#2 or 112#3, failure detection signal IJf-da is set at an H level. Similarly, when disconnection failure occurs at an in-cylinder injector in cylinder 112#1 or 112#4, failure detection signal IJf-db is set at an H level.

Injector driving unit 500*p* includes disconnection detection circuit 530*p* that is provided common to cylinders 112#1-112#4. As mentioned above, the fuel injection period of intake manifold injector 120 is set at an exhaust stroke or intake stroke of each cylinder 112. Since increase of the fuel injection ratio from in-cylinder injector 110 contributes to increasing the output performance at the high output region, fuel injection is conducted mainly from in-cylinder injector 110, and the fuel injection quantity from intake manifold injector 120 is apt to become lower at the operational region where degradation in engine output due to disconnection failure becomes a problem. Since the fuel injection period from each intake manifold injector 120 is set short at such an operation region, the possibility of the fuel injection period of intake manifold injector 120 continuing between the plurality of cylinders 112#1-112#4 is low.

Therefore, the disconnection detection circuit can be shared among intake manifold injectors 120 whose fuel injection period does not overlap in time even in a configuration in which injector driving unit 500*b* is provided common to cylinders 112#1-112#4.

Disconnection detection circuit 530*p* is connected to solenoid coils 121#1-121#4 via supply control transistors Tp1-Tp4. In other words, disconnection detection circuit 530*p* is electrically connected common to solenoid coils 121#1-121#4. Each of solenoid coils 121 #1-121 #4 is connected to disconnection detection circuit 530*p* by a corresponding one of supply control transistors Tp1-Tp4 rendered conductive during a supply power operation by drive control circuit 520*d*. Accordingly, disconnection detection circuit 530*p* monitors whether a counter electromotive force that is to be generated during proper current application of each of connected solenoid coils 111#1-111#4 has been generated or not to set failure detection signal IJf-p at an H level when counter electromotive force is not detected at the H level period of fuel injection signals IJt-d1-IJt-d4. When failure is not detected including the case where counter electromotive force is detected properly, failure detection signal IJf-p is set at an L level. Failure detection signal IJf-p is transmitted to engine ECU 300 from disconnection detection circuit 530*p*.

When disconnection failure occurs at any of intake manifold injectors 120 of cylinder 112, failure detection signal IJf-p is set at an H level.

Engine ECU 300 detects disconnection failure of each of injectors 110 and 120 based on failure detection signals IJf-da, IJf-db and IJf-p from disconnection detection circuits 530*d*, 535*d* and 530*p*, and also crank turning angle CA detected by crank angle sensor 480.

Figure 6:
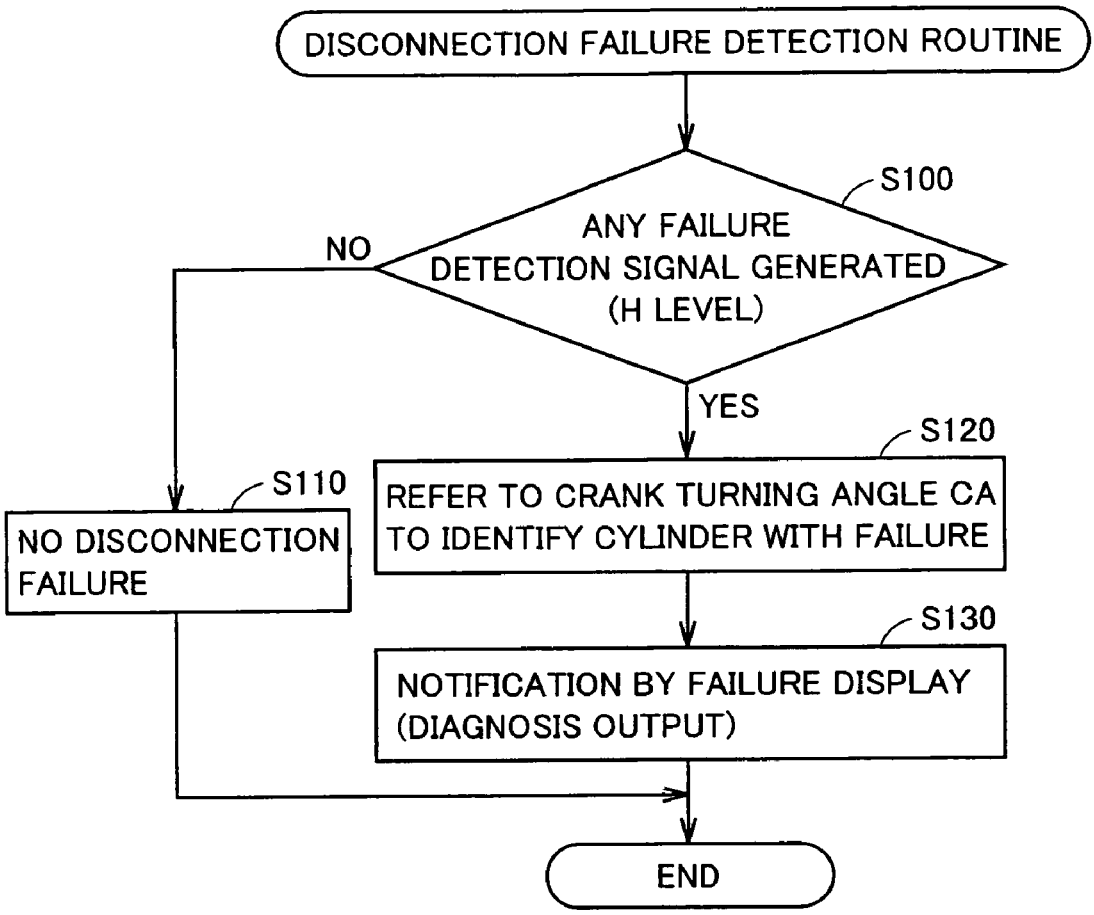
FIG. 6 is a flow chart of an injector disconnection failure detection routine by an engine ECU 300.

FIG. 6 is a flow chart of a disconnection failure detection routine by engine ECU 300, that is actuated periodically.

In the disconnection failure detection routine of FIG. 6, determination is made whether any of failure detection signals IJf-da, IJf-db and IJf-p from disconnection detection circuits 530*d*, 535*d*, and 530*p* is set at an H level (step S100).

When all failure detection signals IJf-da, IJf-db and IJf-p are at an L level (NO determination at step S100), engine ECU 300 determines "No occurrence of disconnection failure" for each of injectors 110 and 120 (step S110), and the disconnection failure detection routine ends.

When any of failure detection signals IJf-da, IJf-db and IJf-p is at an H level (YES determination at step S100), the cylinder with disconnection failure is identified by referring to crank turning angle CA (step S120). Furthermore, the driver is notified (step S130) of the injector disconnection failure detection result including identification of the injector with disconnection failure by display of a diagnosis monitor (not shown). Then, the disconnection failure detection routine ends.

For example, failure detection signal IJf-db at an H level means that disconnection failure has occurred at in-cylinder injector 110 of cylinder 112#1 or 112#4. It is appreciated from FIG. 4 that identification of which of cylinders 112#1 and 112#4 disconnection failure has occurred can be made depending upon which range of 0-360° and 360-720° crank turning angle CA is present. Similarly, when failure detection signal IJf-da is at an H level, identification of occurrence of disconnection failure at either cylinder 112#2 or 112#3 can be made depending upon which range of 0-180°, 540-720°, and 180-540° crank turning angle CA is present.

By providing a disconnection detection circuit for every two cylinders whose phase difference across the same stroke is 360 degrees in crank turning angle for in-cylinder injector 110, injector disconnection failure detection including identification of the cylinder (injector) with disconnection failure can be executed efficiently.

It is assumed that disconnection failure has occurred at intake manifold injector 120 in any of cylinders 112 when failure detection signal IJf-p is at an H level. With regards to intake manifold injector 120 having the fuel injection period generally limited to one stroke (exhaust stroke or intake stroke), the cylinder with disconnection failure can be identified depending upon which range of 0-180°, 180-360°, 360-540°, and 540-720° crank turning angle CA is present.

Thus, even though disconnection detection circuit 530*p* is provided common to intake manifold injector 120, detection of disconnection failure at intake manifold injector 120 and identification of the cylinder with disconnection failure can be executed efficiently.

Since disconnection detection circuits 530*d*, 535*d*, and 530*p* are provided corresponding to both in-cylinder injector 110 and intake manifold injector 120, disconnection failure at a fuel injection mechanism can be detected reliably even under an operation status in which disconnection failure of just one of the injectors will not lead to engine speed variation by the operation of in-cylinder injector 110 and intake manifold injector 120 partaking in fuel injection.

The corresponding relationship between the configuration of FIG. 5 and the configuration of the present invention will be described here. Engine ECU 300 corresponds to "control circuit" of the present invention. Drive control circuits 520*d* and 520*p* correspond to "drive control circuit" of the present invention. Crank angle sensor 480 corresponds to "crank angle detector" of the present invention. Disconnection detection circuits 530*d*, 535*d*, and 530*p* correspond to "failure detection circuit" of the present invention. Particularly, each of disconnection detection circuits 530*d* and 535*d* corresponds to "first failure detection circuit", whereas disconnection detection circuit 530*p* corresponds to "second failure detection circuit" of the present invention.

The above description is based on a configuration of a disconnection detection circuit corresponding to a straight-4 engine. As a modification of the present embodiment, a configuration of a disconnection detection circuit corresponding to a straight-6 engine will be described hereinafter.

Referring to FIG. 7, crankshaft 200 is provided common to each cylinder 112 of engine 10. Each of cylinders #1-#6 is coupled to crankshaft 200 by the coupling of one end of connecting rod 106 with crankpin 205. Accordingly, the reciprocating motion of piston 103 at cylinders #1-#6 that are sequentially ignited is converted into the rotary motion of crankshaft 200 with crank rotary axis 202 as the center axis.

As shown in FIG. 8, cylinders #1-#6 are sequentially ignited in the order of, for example, #1→#5→#3→#6→#2→#4, and respective strokes are sequentially executed at each cylinder. The phase difference of each stroke between adjacent cylinders in ignition order corresponds to 120 degrees in crank turning angle.

Likewise FIG. 4, two turns (720 degrees) of crankshaft 200 corresponds to one engine cycle. By crank angle sensor 480 of FIG. 1, the crank turning angle can be detected at the step of a predetermined angle corresponding to the arranged pitch of the projection in the range of 0°-720° in crank turning angle.

In accordance with the ignition order set forth above, the phase difference across the same stroke is 360 degrees in crank turning angle between cylinders #1 and #6, between cylinders #2 and #5, and between cylinders #3 and #4.

Figure 9:
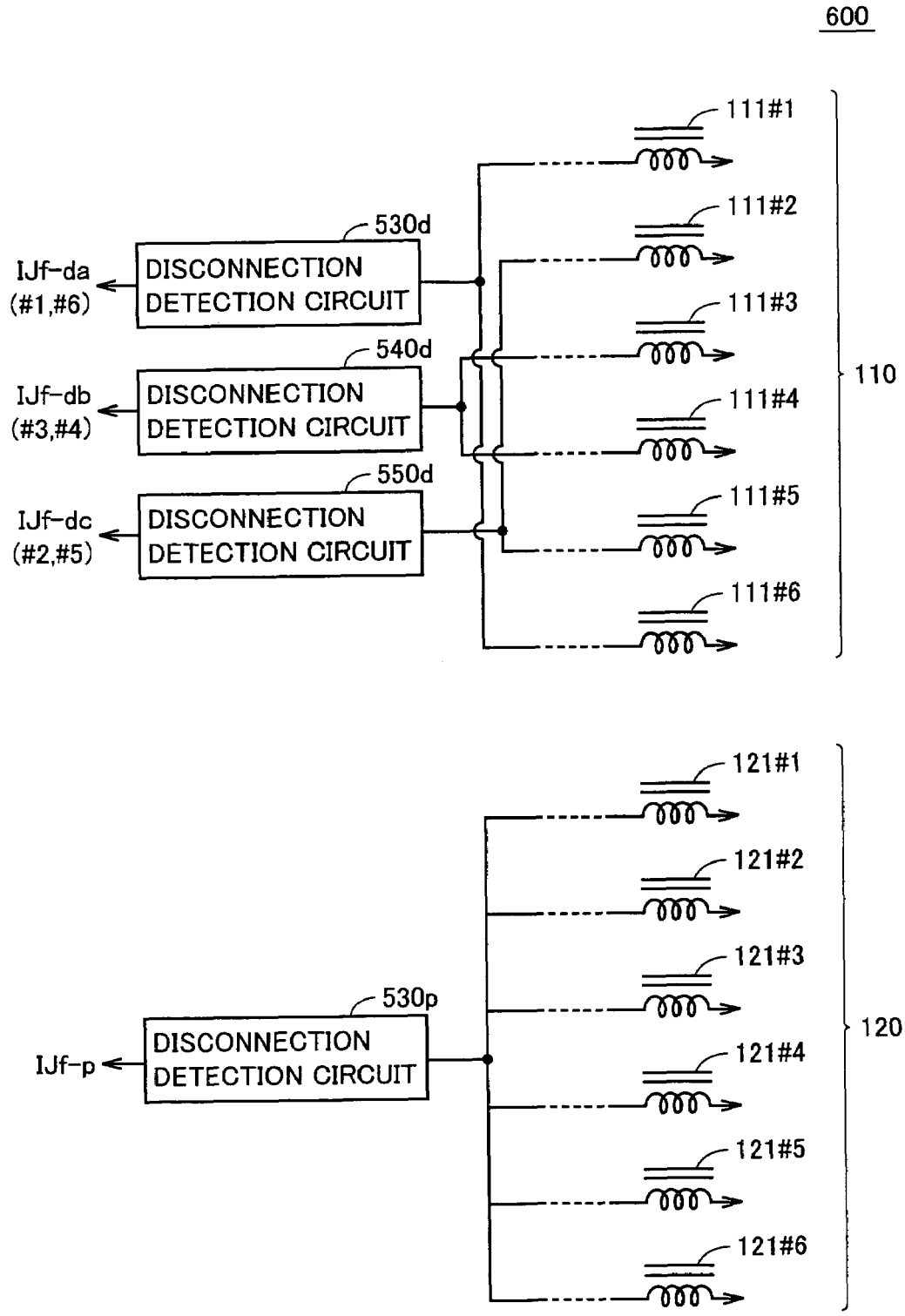
FIG. 9 is a block diagram to describe an exemplified configuration of a disconnection detection circuit in a 6-cylinder engine.

Therefore, in a failure detection system 600 of a straight-6 engine, as shown in FIG. 9, three disconnection detection circuits 530*d*, 540*d*, and 550*d* are arranged with respect to in-cylinder injector 110 provided at each of cylinders #1-#6. Disconnection detection circuit 530*d* is electrically connected to solenoid coils 111#1 and 111#6 included in each in-cylinder injector 110 of cylinders #1 and #6. Similarly, disconnection detection circuit 540*d* is electrically connected to solenoid coils 111#3 and 111#4 included in each in-cylinder injector 110 of cylinders #3 and #4. Disconnection detection circuit 550*d* is electrically connected to solenoid coils 111#2 and 111#5 included in each in-cylinder injector 110 of cylinders #2 and #5.

Each of disconnection detection circuits 530*d*, 540*d*, and 550*d* is configured in a manner similar to that of disconnection detection circuits 530*d* and 535*d* shown in FIG. 5. Whether current has been applied properly or not in response to a corresponding fuel injection signal is monitored for each solenoid coil connected by conduction of a supply control transistor (FIG. 5).

Thus, when disconnection failure occurs in in-cylinder injector 110 at cylinder #1 or #6, failure detection signal IJf-da from disconnection detection circuit 530*d* is set at an H level. Similarly, when disconnection failure occurs at in-cylinder injector 110 of cylinder #3 or #4, failure detection signal IJf-db from disconnection detection circuit 540*d* is set at an H level. When disconnection failure occurs at in-cylinder injector 110 of cylinder #2 or #5, failure detection signal IJf-dc from disconnection detection circuit 550*d* is set at an H level. Failure detection signals IJf-da, IJf-db, and IJf-dc are transmitted to engine ECU 30 from disconnection detection circuits 530*d*, 540*d* and 550*d*.

In contrast, a common disconnection detection circuit 530*p* is provided for each intake manifold injector 120. Disconnection detection circuit 530*p* is electrically connected common to solenoid coils 121#1-121#6 included in each intake manifold injector 120 of cylinders #1-#6.

As shown in FIG. 5, disconnection detection circuit 530*p* monitors whether current has been applied properly in response to a corresponding fuel injection signal for a solenoid coil connected by conduction of the supply control transistor (FIG. 5). Thus, when disconnection failure occurs at intake manifold injector 120 of any of cylinders #1-#6, failure detection signal IJf-p from disconnection detection circuit 530*p* is set at an H level. Failure detection signal IJf-p is transmitted to engine ECU 300.

By the configuration set forth above, disconnection failure at each of injectors 110 and 120 can be detected based on failure detection signals IJf-da, IJf-db, IJf-dc, IJf-p, and also crank turning angle CA from crank angle sensor 480 according to the disconnection failure detection routine shown in FIG. 6 at engine ECU 300.

Since the fuel injection period from each intake manifold injector 120 is set short in an operation region where degradation in engine output caused by disconnection failures becomes a problem, the possibility of the fuel injection period from intake manifold injector 120 continuing among the plurality of cylinders #1-#6 is low. Therefore, a configuration of providing disconnection detection circuit 530*p* common to cylinders #1-#6 for a straight-6 engine can be realized.

If disconnection failure detection of intake manifold injector 120 is to be carried out more precisely, the number of disconnection detection circuits arranged can be increased. For example, it is appreciated from FIG. 8 that an independent disconnection detection circuit for the group of cylinders #1-#3 and the group of cylinders #4-#6 with intake strokes that do not overlap can be established.

As set forth above, disconnection failure detection similar to that of FIG. 5 can be carried out for in-cylinder injector 110 and intake manifold injector 120 for a straight-6 engine.

The corresponding relationship between the configuration of FIG. 9 and the configuration of the present invention will be described here. Disconnection detection circuits 530*d*, 540*d*, 550*d*, and 530*p* correspond to "failure detection circuit" of the present invention. Particularly, each of disconnection detection circuits 530*d*, 540*d*, and 550*d* corresponds to "first failure detection circuit", and disconnection detection circuit 530*p* corresponds to "second failure detection circuit" of the present invention.

The above embodiment was described in which the failure detection circuit is shared among injectors whose fuel injection period does not overlap, corresponding to both in-cylinder injector 110 and intake manifold injector 120. However, application of the present invention is not limited to such a configuration. A failure detection circuit can be shared among injectors whose fuel injection period does not overlap with respect to only one of in-cylinder injector 110 and intake manifold injector 120, and provide a failure detection circuit for each injector for the other of in-cylinder injector 110 and intake manifold injector 120.

Further, the present invention can be applied without being limited to the number (type) of injectors provided at each cylinder. For example, the failure detection circuit can be shared among injectors whose fuel injection period does not overlap for an engine with a unitary injector provided at each cylinder. As an alternative configuration for an engine having three or more (different types) of injectors provided at each cylinder, the disconnection detection circuit can be shared among injectors whose fuel injection period does not overlap by arranging a disconnection detection circuit for each group of injectors corresponding to one type.

The setting of a preferable DI ratio for the invention of the present embodiment will be described hereinafter.

Figure 10:
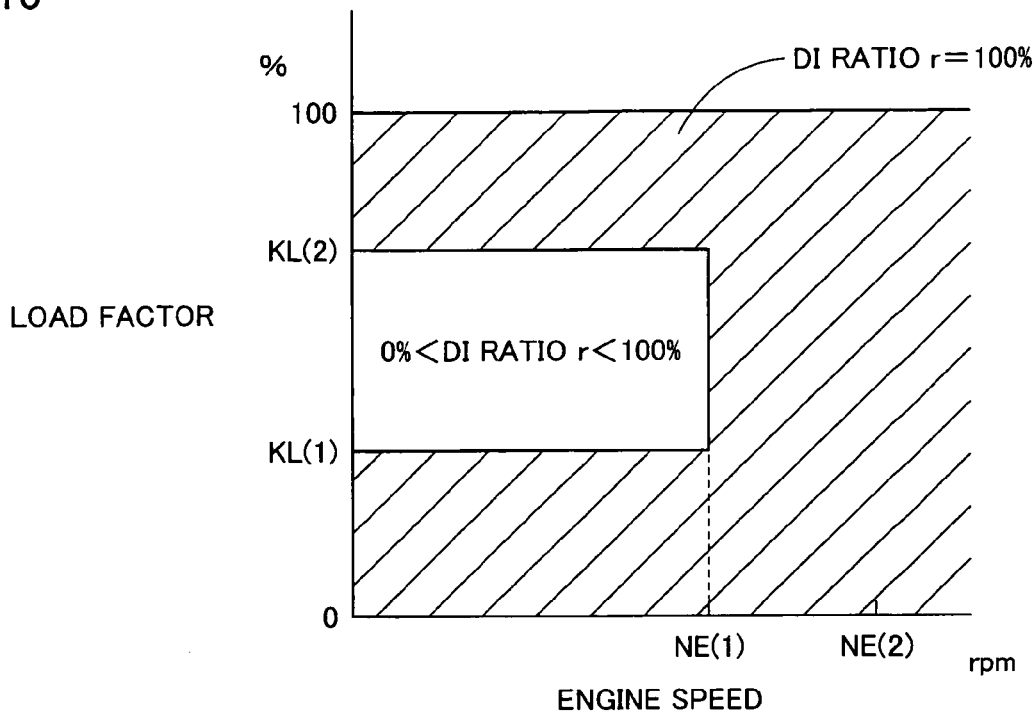
FIG. 10 is a diagram to describe a first example of a DI ratio setting map (engine warming time) in the engine system of FIG. 1.
Figure 11:
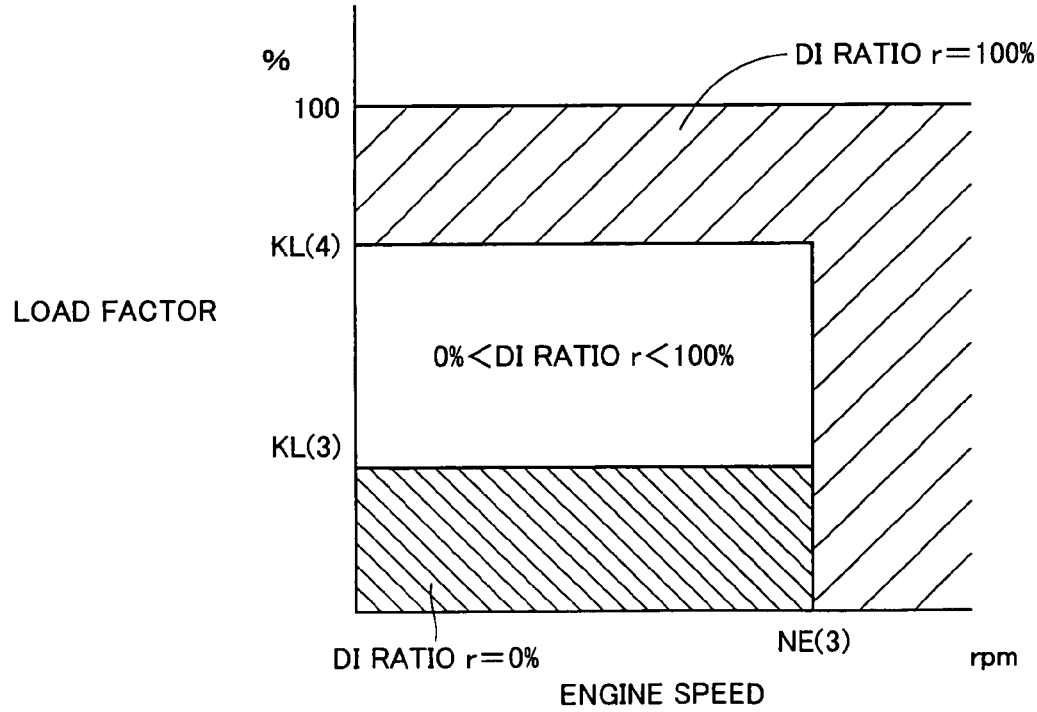
FIG. 11 is a diagram to describe the first example of a DI ratio setting map (engine cooling time) in the engine system of FIG. 1.

FIGS. 10 and 11 are diagrams to describe a first example of a DI ratio setting map in the engine system of FIG. 1.

The maps shown in FIGS. 10 and 11 are stored in ROM 320 of an engine ECU 300. FIG. 10 is the map for a warm state of engine 10, and FIG. 11 is the map for a cold state of engine 10.

In the maps of FIGS. 10 and 11, the fuel injection ratio of in-cylinder injector 110 is expressed in percentage as the DI ratio r, wherein the engine speed of engine 10 is plotted along the horizontal axis and the load factor is plotted along the vertical axis.

As shown in FIGS. 10 and 11, the DI ratio r is set for each operation region that is determined by the engine speed and the load factor of engine 10, based on the maps for the warm state and the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 10 is selected; otherwise, the map for the cold state shown in FIG. 11 is selected. In-cylinder injector 10 and/or intake manifold injector 120 are controlled based on the engine speed and the load factor of engine 10 in accordance with the selected map.

The engine speed and the load factor of engine 10 set in FIGS. 10 and 11 will now be described. In FIG. 10, NE(1) is set to 2500 rpm to 2700 rpm, KL(1) is set to 30% to 50%, and KL(2) is set to 60% to 90%. In FIG. 11, NE(3) is set to 2900 rpm to 3100 rpm. That is, NE(1)<NE(3). NE(2) in FIG. 10 as well as KL(3) and KL(4) in FIG. 11 are also set appropriately.

In comparison between FIG. 10 and FIG. 11, NE(3) of the map for the cold state shown in FIG. 11 is greater than NE(1) of the map for the warm state shown in FIG. 10. This shows that, as the temperature of engine 10 becomes lower, the control region of intake manifold injector 120 is expanded to include the region of higher engine speed. That is, in the case where engine 10 is cold, deposits are unlikely to accumulate in the injection hole of in-cylinder injector 110 (even if fuel is not injected from in-cylinder injector 110). Thus, the region where fuel injection is to be carried out using intake manifold injector 120 can be expanded, whereby homogeneity is improved.

In comparison between FIG. 10 and FIG. 11, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 alone is used in the region of a predetermined high engine speed, and in the region of a predetermined high engine load. That is, in the high speed region or the high load region, even if fuel injection is carried out through in-cylinder injector 110 alone, the engine speed and the load of engine 10 are so high and the intake air quantity so sufficient that it is readily possible to obtain a homogeneous air-fuel mixture using only in-cylinder injector 110. In this manner, the fuel injected from in-cylinder injector 10 is atomized in the combustion chamber involving latent heat of vaporization (or, absorbing heat from the combustion chamber). Thus, the temperature of the air-fuel mixture is decreased at the compression end, so that the anti-knocking performance is improved. Further, since the temperature in the combustion chamber is decreased, intake efficiency is improved, leading to high power.

In the map for the warm state in FIG. 10, fuel injection is also carried out using in-cylinder injector 110 alone when the load factor is KL(1) or less. This shows that in-cylinder injector 110 alone is used in a predetermined low-load region when the temperature of engine 10 is high. When engine 10 is in the warm state, deposits are likely to accumulate in the injection hole of in-cylinder injector 110. However, when fuel injection is carried out using in-cylinder injector 10, the temperature of the injection hole can be lowered, in which case accumulation of deposits is prevented. Further, clogging at in-cylinder injector 110 may be prevented while ensuring the minimum fuel injection quantity thereof Thus, in-cylinder injector 110 solely is used in the relevant region.

In comparison between FIG. 10 and FIG. 11, the region of "DI RATIO r=0%" is present only in the map for the cold state of FIG. 11. This shows that fuel injection is carried out through intake manifold injector 120 alone in a predetermined low-load region (KL(3) or less) when the temperature of engine 10 is low. When engine 10 is cold and low in load and the intake air quantity is small, the fuel is less susceptible to atomization. In such a region, it is difficult to ensure favorable combustion with the fuel injection from in-cylinder injector 110. Further, particularly in the low-load and low-speed region, high power using in-cylinder injector 110 is unnecessary. Accordingly, fuel injection is carried out through intake manifold injector 120 alone, without using in-cylinder injector 110, in the relevant region.

Further, in an operation other than the normal operation, or, in the catalyst warm-up state during idling of engine 10 (an abnormal operation state), in-cylinder injector 110 is controlled such that stratified charge combustion is effected. By causing the stratified charge combustion only during the catalyst warm-up operation, warming up of the catalyst is promoted to improve exhaust emission.

Figure 12:
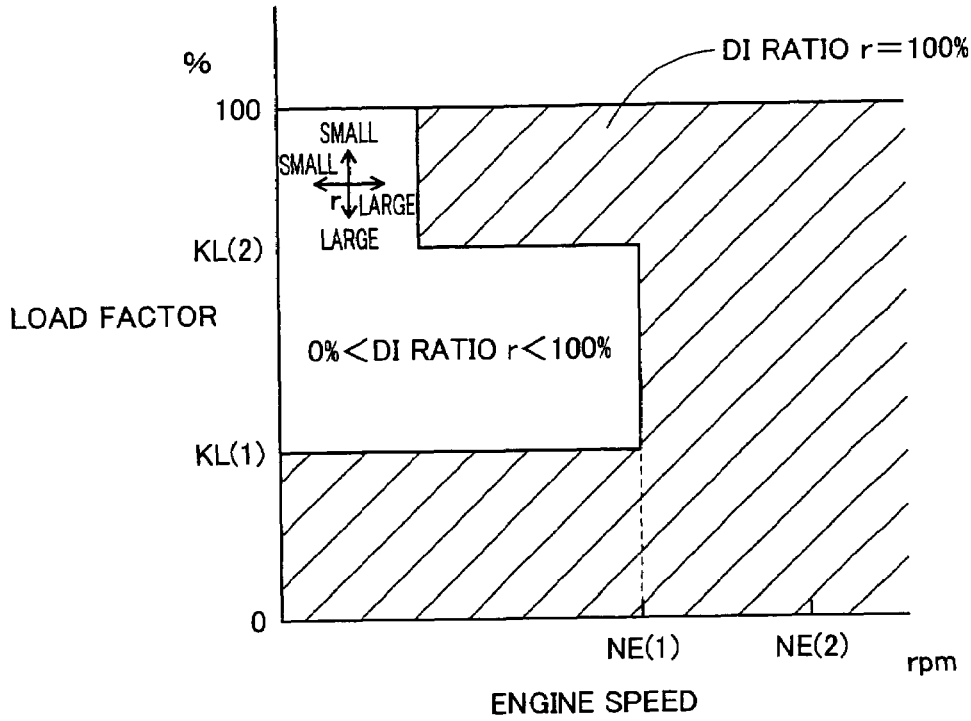
FIG. 12 is a diagram to describe a second example of a DI ratio setting map (engine warming time) in the engine system of FIG. 1.
Figure 13:
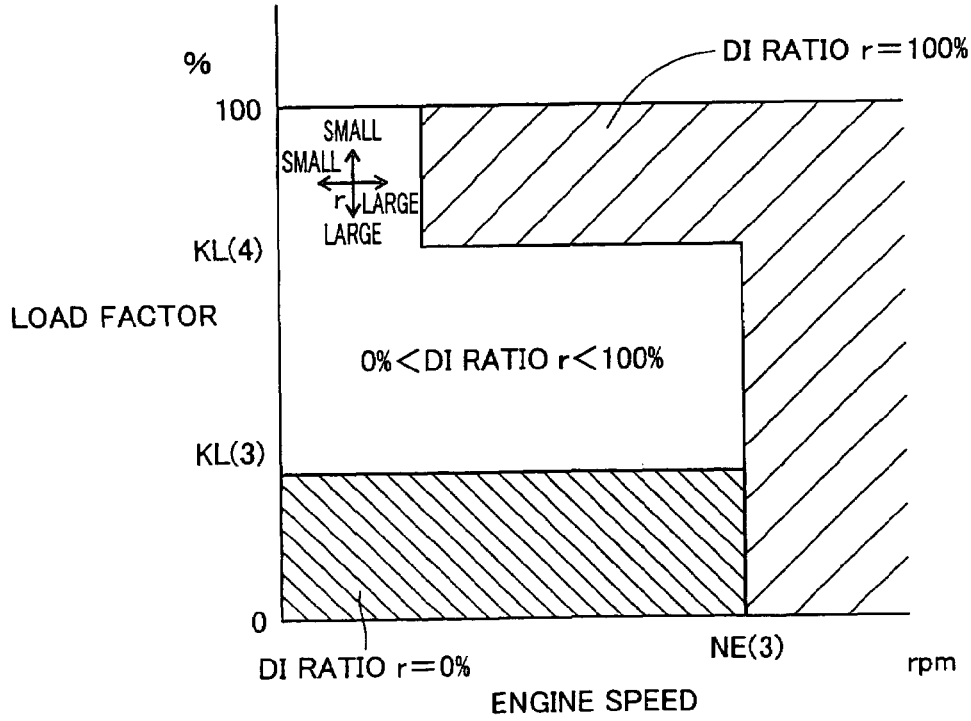
FIG. 13 is a diagram to describe the second example of a DI ratio setting map (engine cooling time) in the engine system of FIG. 1.

FIGS. 12 and 13 represent a second example of a DI ratio setting map of the engine system of FIG. 1.

The setting maps of FIG. 12 (warming state) and FIG. 13 (cooling state) differ from the setting maps of FIGS. 10 and 11 in that the DI ratio setting at a high load region of a low engine speed region differs.

In the low speed and high load regions for engine 10, mixing of air-fuel mixture produced by the fuel injected from in-cylinder injector 110 is poor, and the inhomogeneous air-fuel mixture in the combustion chamber may lead to unstable combustion. Accordingly, the injector ratio of in-cylinder injector 110 is to be increased in transition to the high speed region where such a problem is unlikely to occur. The fuel injection ratio of in-cylinder injector 110 is to be decreased in accordance with transition to the high load region where such a problem is likely to occur. This changes in the DI ratio r are shown by crisscross arrows in FIGS. 12 and 13.

In this manner, variation in the output torque of the engine attributable to the unstable combustion can be suppressed. It is noted that these measures are substantially equivalent to the measures to decrease the fuel injection ratio of in-cylinder injector 110 in connection with transition to a predetermined low speed region, or increase the fuel injection ratio of in-cylinder injector 110 in connection with transition to a predetermined low load region. Further in a region other than the region set forth above (the region indicated by the crisscross arrows in FIGS. 12 and 13), and where fuel injection is carried out by only in-cylinder injector 110 (the high speed side and low load side), the air-fuel mixture can be readily set homogenous even when the fuel injection is carried out using only in-cylinder injector 110. In this case, the fuel injected from in-cylinder injector 110 is atomized in the combustion chamber involving latent heat of vaporization (by absorbing heat from the combustion chamber). Accordingly, the temperature of the air-fuel mixture is decreased at the compression end whereby the antiknock performance is improved. Further, with the decrease temperature of the combustion chamber, intake efficiency is improved, leading to high power output.

The DI ratio setting of other regions in the setting maps of FIGS. 12 and 13 are similar to those of FIG. 10 (warming state) and FIG. 11 (cooling state). Therefore, detailed description thereof will not be repeated.

In engine 10 described in conjunction with FIGS. 10-13, homogeneous combustion is realized by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in totality is ignited in the combustion chamber to realize the stratified charge combustion. Even if the fuel injection timing of in-cylinder injector 110 is set in the intake stroke, stratified charge combustion can be realized if a rich air-fuel mixture can be located locally around the spark plug.

As used herein, the stratified charge combustion includes both the stratified charge combustion and semi-stratified charge combustion set forth below. In the semi-stratified charge combustion, intake manifold injector 120 injects fuel in the intake stroke to generate a lean and homogeneous air-fuel mixture in totality in the combustion chamber, and then in-cylinder injector 110 injects fuel in the compression stroke to generate a rich air-fuel mixture around the spark plug, so as to improve the combustion state. Such a semi-stratified charge combustion is preferable in the catalyst warm-up operation for the following reasons. In the catalyst warm-up operation, it is necessary to considerably retard the ignition timing and maintain a favorable combustion state (idling state) so as to cause a high-temperature combustion gas to arrive at the catalyst. Further, a certain quantity of fuel must be supplied. If the stratified charge combustion is employed to satisfy these requirements, the quantity of fuel will be insufficient. With the homogeneous combustion, the retarded amount for the purpose of maintaining favorable combustion is small as compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine described in conjunction with FIGS. 10-13, the fuel injection timing by in-cylinder injector 110 is preferably set in the compression stroke for the reason set forth below. It is to be noted that, for most of the fundamental region (here, the fundamental region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state), the fuel injection timing of in-cylinder injector 110 is set at the intake stroke. The fuel injection timing of in-cylinder injector 110, however, may be set temporarily in the compression stroke for the purpose of stabilizing combustion, as will be described hereinafter.

When the fuel injection timing of in-cylinder injector 110 is set in the compression stroke, the air-fuel mixture is cooled by the fuel injection during the period where the temperature in the cylinder is relatively high. This improves the cooling effect and, hence, the antiknock performance. Further, when the fuel injection timing of in-cylinder injector 110 is set in the compression stroke, the time required starting from fuel injection up to the ignition is short, so that the air current can be enhanced by the atomization, leading to an increase of the combustion rate. With the improvement of antiknock performance and the increase of combustion rate, variation in combustion can be obviated to allow improvement in combustion stability.

The DI ratio map for the warming state shown in FIG. 10 or 12 may be employed when in an off idle mode (when the accelerator pedal is depressed when the idle switch is off) independent of the temperature of engine 10 (in either a warming state or cooling state). This means that in-cylinder injector 110 is used in the low load region regardless of the warming state and cooling state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine including a plurality of cylinders coupled to a common crankshaft, and having fuel injection means for injecting fuel when current is applied, arranged at each cylinder, said control apparatus comprising:

a control circuit configured to generate a control signal indicating a fuel injection period from said fuel injection means, a drive control circuit configured to supply power to said fuel injection means in response to said control signal from said control circuit, a failure detection circuit electrically connected to at least one said fuel injection means, and configured to detect, when power is supplied to the connected fuel injection means by said drive control circuit, disconnection failure at said connected fuel injection means, and a crank angle detector detecting a turning angle of said crankshaft, wherein said failure detection circuit is arranged to be electrically connected common to a plurality of said fuel injection means whose fuel injection period does not overlap in time, and said control circuit includes means for identifying a fuel injection means with said disconnection failure based on a detected result by said failure detection circuit and said turning angle detected by said crank angle detector.

2. A control apparatus for an internal combustion engine including a plurality of cylinders coupled to a common crankshaft, and having first fuel injection means for injecting fuel into a cylinder and second fuel injection means for injecting fuel into an intake manifold when current is applied, arranged at each cylinder, said control apparatus comprising:

a control circuit configured to control a fuel injection ratio of fuel injection quantity between said first fuel injection means and said second fuel injection means to an entire fuel injection quantity according to an operating state, and generate a plurality of control signals respectively indicating a fuel injection period of said first and second fuel injection means at each said cylinder according to said entire fuel injection quantity and said fuel injection ratio, a drive control circuit configured to supply power to said first and second fuel injection means at each said cylinder in response to said plurality of control signals from said control circuit, a first failure detection circuit electrically connected to at least one said first fuel injection means, and configured to detect, when power is supplied to the connected first fuel injection means by said drive control circuit, disconnection failure of said connected first fuel injection means, a second failure detection circuit electrically connected to at least one said second fuel injection means, and configured to detect, when power is supplied to the connected second fuel injection means by said drive control circuit, disconnection failure of said connected second fuel injection means, and a crank angle detector detecting a turning angle of said crankshaft, wherein at least one of said first and second failure detection circuits is arranged to be electrically connected common to a plurality of corresponding the fuel injection means whose fuel injection period does not overlap in time, and said control circuit includes means for identifying first fuel injection means and second fuel injection with said disconnection failure based on a detected result by said failure detection circuit and said turning angle detected by said crank angle detector.

3. The control apparatus for an internal combustion engine according to claim 2, wherein said first failure detection circuit is arranged for every two cylinders whose phase difference across the same stroke is 360 degrees in said turning angle, and electrically connected common to said first fuel injection means arranged in each of said two cylinders.

4. The control apparatus for an internal combustion engine according to claim 2, wherein said second failure detection circuit is arranged to be electrically connected common to said second fuel injection means arranged in each said cylinder.

5. A control apparatus for an internal combustion engine including a plurality of cylinders coupled to a common crankshaft, and having a fuel injection mechanism injecting fuel when current is applied arranged at each cylinder, said control apparatus comprising:

a control circuit configured to generate a control signal indicating a fuel injection period from said fuel injection mechanism, a drive control circuit configured to supply power to said fuel injection mechanism in response to said control signal from said control circuit, a failure detection circuit electrically connected to at least one said fuel injection mechanism, and configured to detect, when power is supplied to the connected fuel injection mechanism by said drive control circuit, disconnection failure at said connected fuel injection mechanism, and a crank angle detector detecting a turning angle of said crankshaft, wherein said failure detection circuit is arranged to be electrically connected common to a plurality of said fuel injection mechanism whose fuel injection period does not overlap in time, and said control circuit identifying a fuel injection mechanism with said disconnection failure based on a detected result by said failure detection circuit and said turning angle detected by said crank angle detector.

6. A control apparatus for an internal combustion engine including a plurality of cylinders coupled to a common crankshaft, and having a first fuel injection mechanism for injecting fuel into a cylinder and a second fuel injection mechanism for injecting fuel into an intake manifold when current is applied, arranged at each cylinder, said control apparatus comprising:

a control circuit configured to control a fuel injection ratio of fuel injection quantity between said first fuel injection mechanism and said second fuel injection mechanism to an entire fuel injection quantity according to an operating state, and generate a plurality of control signals respectively indicating a fuel injection period of said first and second fuel injection mechanisms at each said cylinder according to said entire fuel injection quantity and said fuel injection ratio, a drive control circuit configured to supply power to said first and second fuel injection mechanisms at each said cylinder in response to said plurality of control signals from said control circuit, a first failure detection circuit electrically connected to at least one said first fuel injection mechanism, and configured to detect, when power is supplied to the connected first fuel injection mechanism by said drive control circuit, disconnection failure of said connected first fuel injection mechanism, a second failure detection circuit electrically connected to at least one said second fuel injection mechanism, and configured to detect, when power is supplied to the connected second fuel injection mechanism by said drive control circuit, disconnection failure of said connected second fuel injection mechanism, and a crank angle detector detecting a turning angle of said crankshaft, wherein at least one of said first and second failure detection circuits is arranged to be electrically connected common to a plurality of corresponding the fuel injection mechanisms whose fuel injection period does not overlap in time, and said control circuit identifying first and second fuel injection mechanisms with said disconnection failure based on a detected result by said failure detection circuit and said turning angle detected by said crank angle detector.

7. The control apparatus for an internal combustion engine according to claim 6, wherein said first failure detection circuit is arranged for every two cylinders whose phase difference across the same stroke is 360 degrees in said turning angle, and electrically connected common to said first fuel injection mechanism arranged in each of said two cylinders.

8. The control apparatus for an internal combustion engine according to claim 6, wherein said second failure detection circuit is arranged to be electrically connected common to said second fuel injection mechanism arranged in each said cylinder.

* * * * *